United States Patent [19]

Frank

[11] Patent Number: 4,480,818

[45] Date of Patent: Nov. 6, 1984

[54] SAFETY ENHANCEMENT DEVICE FOR WELL-LOGGING CABLE SHEAVE WHEELS

[75] Inventor: Larry D. Frank, Kingwood, Tex.

[73] Assignee: Schlumberger Technology Corporation, Houston, Tex.

[21] Appl. No.: 414,151

[22] Filed: Sep. 2, 1982

[51] Int. Cl.[3] ..... B66D 3/04

[52] U.S. Cl. ..... 254/411

[58] Field of Search ..... 254/271, 373, 383, 402, 254/403, 405, 407, 409, 411; 242/157 R

[56] References Cited

U.S. PATENT DOCUMENTS

| | | | |
|---|---|---|---|
| 1,379,868 | 5/1921 | Kelsey | 254/411 X |
| 1,856,993 | 5/1932 | Irwin | 254/411 |
| 1,975,940 | 10/1934 | Harding | 254/411 X |
| 2,637,525 | 5/1953 | Lock | 254/383 X |
| 2,728,552 | 12/1955 | Fate | 254/402 |
| 2,800,300 | 7/1957 | Johnson et al. | 254/194 |
| 3,171,633 | 3/1965 | Le Bus et al. | 254/190 |
| 3,962,943 | 6/1976 | Allen | 83/370 |

*Primary Examiner*—John M. Jillions
*Assistant Examiner*—Joseph J. Hail, III

[57] ABSTRACT

A safety enhancement device for a well-logging cable sheave wheel rotatably mounted in a frame member has a guard plate which assists in the prevention of foreign objects passing into the pinch-point between the well-logging cable and the sheave wheel.

4 Claims, 6 Drawing Figures

SAFETY ENHANCEMENT DEVICE FOR WELL-LOGGING CABLE SHEAVE WHEELS

FIELD OF THE INVENTION

The invention relates to a safety enhancement device for well-logging cable sheave wheels used in conducting well-logging operations in a borehole.

DESCRIPTION OF THE PRIOR ART

When conducting well-logging operations in a borehole, it is necessary to raise and lower the well-logging tool within the borehole by means of a well-logging cable. One end of the well-logging cable is attached to the well-logging tool via a well-logging tool connector, and the other end of the well-logging cable is attached to a winch apparatus which may be disposed on a suitable truck. It is conventional to pass the well-logging cable over a plurality of conventional sheave wheels disposed between the winch apparatus and the borehole. Typically, there is a lower sheave wheel which may be conventionally attached, as by chains, to the derrick structure and the wellhead. The lower sheave wheel is normally disposed above the derrick platform or the earth's surface, such that it is possible for oil field workmen on the platform to grasp the well-logging cable before it passes over the lower sheave wheel. Although written warnings are displayed on the sheave wheel to stay clear of the sheave wheel and repeated safety lectures are given to the workmen not to grasp the moving well-logging cable, the possibility still exists that such workmen negligently will disregard such warnings to their detriment and they will grasp the moving well-logging cable. Potentially, the result is that the workman's hand, which is grasped upon the well-logging cable, could move with the cable and be pulled into the pinch-point, or position on the sheave wheel, where the moving well-logging cable first contacts the sheave wheel. When such an event occurs, a severe injury to the workman's hand may occur.

Previously, the well-logging industry has relied upon written warnings and numerous safety lectures to attempt to prevent any injuries associated with the sheave wheels utilized in connection with well-logging operations. Additionally, various types of covers have been used in connection with the sheave wheels. It is necessary to assemble these covers in place prior to conducting well-logging operations, as well as disassemble and remove them when moving the sheave wheel to another derrick. Despite repeated safety warnings, some workmen negligently decide that they do not want to perform the extra steps necessary to assemble and disassemble the covers and delete them, which thus decreases the safety enhancement potential of such covers.

Accordingly, prior to the development of the present invention, there has been no safety enhancement device for a well-logging cable sheave wheel which is simple in operation, is easily assembled and manufactured, and enhances safety in the operation of a well-logging cable about a sheave wheel. Therefore, the art has sought a safety enhancement device for use with well-logging cable sheave wheels which is simple and efficient in its operation, is easily manufactured and assembled, becomes a permanent component part of the sheave wheel, and serves to enhance the safety of operation of a well-logging cable about a sheave wheel.

SUMMARY OF THE INVENTION

In accordance with the invention the foregoing advantages have been achieved through the present safety enhancement device for a well-logging cable sheave wheel rotatably mounted in a frame member, the sheave wheel having a pinch-point located where the well-logging cable first contacts the sheave wheel, for use in well-logging operations. The present invention includes: means for guiding and restraining the well-logging cable as it travels around the sheave wheel; means for stabilizing and positioning the guiding and restraining means with respect to the sheave wheel; and means for assisting in the prevention of foreign objects passing into the pinch-point, whereby the foreign objects do not become disposed between the well-logging cable and the sheave wheel.

A feature of the present invention is that the assisting in prevention means comprises at least one guard plate adjustably mounted with respect to the guiding and restraining means and the stabilizing and positioning means. A further feature of the present invention is that the at least one guard plate has an opening therein sized to allow the well-logging cable to pass therethrough and further sized to assist in preventing foreign objects from passing therethrough. An additional feature of the present invention is that the guard plate may include means for releasably securing the guard plate to the stabilizing and positioning means. The guard plate may be pivotably mounted with respect to the guiding and restraining means and the stabilizing and positioning means.

Another feature of the present invention resides in the fact that the stabilizing and positioning means may comprise at least one extendable member having a first end associated with the frame member and a second end associated with the guiding and restraining means. The stabilizing and positioning means may include means for adjusting and locking the length of the at least one extendable member. A further feature of the present invention is that the at least one extendable member may comprise an inner and an outer tubular arm with the inner tubular arm slidingly disposed within the outer tubular arm; and the adjusting and locking means comprises a plurality of mating holes in the arms and a pin member adapted to be inserted in the mating holes.

An additional feature of the present invention resides in the fact that the guiding and restraining means and the stabilizing and positioning means may each be pivotably mounted with respect to each other and with respect to the sheave wheel frame member. A further feature of the present invention is that the stabilizing and positioning means may include at least two extendable arms having their first ends pivotably mounted to an end of the sheave wheel frame member; the guiding and restraining means may include at least two guide arms having their first ends pivotably mounted to the sheave wheel frame member, and their second ends pivotably mounted to the second ends of the extendable arms; and the guard plate may be pivotably mounted with respect to the second ends of the guide arms and extendable arms.

Another feature of the present invention is that the guiding and restraining means and the stabilizing and positioning means may be pivotably mounted with respect to each other and with respect to the sheave wheel frame member; both of said means being moveable from a first collapsed transporting position, to facilitate movement of the sheave wheel and frame member by rolling the sheave wheel, to a second operating extended position with the assisting and prevention means disposed adjacent the point of contact between the sheave wheel and well-logging cable.

The safety enhancement device for a well-logging cable sheave wheel rotatably mounted in the frame member of the present invention, serves to enhance the safe operation of the sheave wheel for those workmen who negligently ignore safety warnings, and has the advantages of ease of operation and assembly, is a permanent component part of the sheave wheel, and allows the safety enhancement device to be collapsed whereby the sheave wheel can be moved to another location.

While the invention will be described in connection with the preferred embodiment, it will be understood that it is not intended to limit the invention to that embodiment. On the contrary, it is intended to cover all alternatives, modifications, and equivalents as may be included within the spirit and scope of the invention as defined by the appended claims.

DETAILED DESCRIPTION OF THE INVENTION

Figure 1:
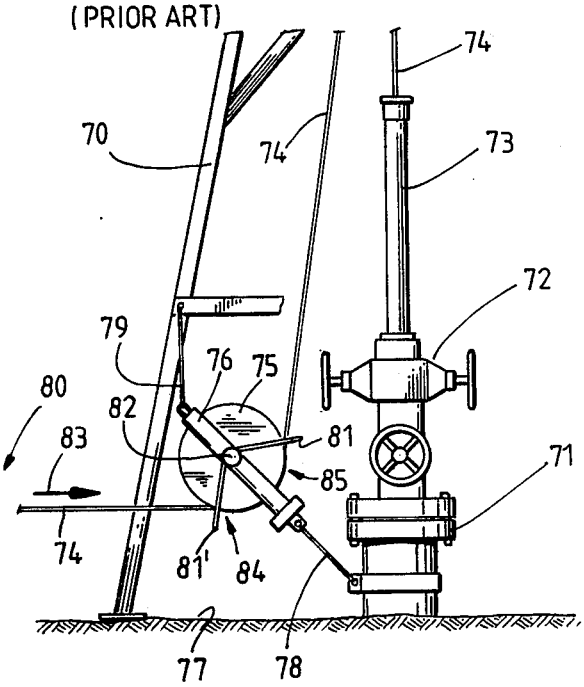
Fig. 1 (PRIOR ART)
FIG. 1 is a plan view illustrating a prior art sheave wheel in use in connection with well-logging operations.

In FIG. 1, a portion of a derrick structure 70 is shown disposed about a conventional wellhead 71, blowout preventer 72, and lubricator 73. A conventional well-logging cable 74 is shown to pass about a well-logging cable sheave wheel 75 which is rotatably mounted within a frame member 76. The ends of the frame member 76 are supported above the derrick floor, or ground, 77 as by chains 78 and 79 in a conventional manner. Chain 78 is secured to a portion of the wellhead 71, and chain 79 is secured to a portion of the derrick structure 70. Well-logging cable has one of its ends beyond point 80 attached to a conventional winch apparatus (not shown) which may be mounted on a well-logging truck (not shown). Well-logging cable 74 passes around sheave wheel 75 and upwardly toward the upper end of the derrick structure 70. Well-logging cable 74 in turn passes over another sheave wheel (not shown) and then passes downwardly through lubricator 73, blowout preventor 72, and through wellhead 71. The lower end of well-logging cable 74 is in turn secured to a well-logging tool (not shown) in a conventional manner. The sheave wheel frame member 76 is provided with two guide arms 81 and 81' which are held in the approximate position shown in FIG. 1 with respect to frame member 76 as by a frictional engagement at pivot point 82 of frame member 76. As will be hereinafter described, the prior art guide arms 81 serve to keep the well-logging cable within the grooved outer surface of sheave wheel 75 and help to prevent the well-logging cable from jumping off the sheave wheel 75.

As will be hereinafter described in connection with FIG. 6, the prior art guide arms 81 have an opening therein which is sized to allow the well-logging cable 74 and the well-logging tool connector (not shown) to pass through the guide arms 81. Such opening is thus large enough to allow a foreign object, such as a workman's hand (not shown), to pass through such opening. Thus, were the well-logging tool to be lowered, well-logging cable 74 would be moving in the direction shown by arrow 83. Upon a workman negligently grasping moving well-logging cable 74, his hand could travel with well-logging cable 74 through the opening of guide arm 81'. His hand could be drawn between well-logging cable 74 and sheave wheel 75 at the pinch-point 84, whereby the workman could sustain a severe injury to his hand. Conversely, were well-logging cable 74 to be moving in a direction opposite to that shown by arrow 83 to raise the well-logging tool and upon grasping well-logging cable 74 at a location above guide arm 81, a hand could be drawn through guide arm 81 and into the pinch-point generally shown at 85. Pinch-points 84 and 85 are those locations on sheave wheel 75 where the well-logging cable 74 first contacts the outer periphery of sheave wheel 75. It should be readily understood that the location of pinch-points 84 and 85 could vary dependent upon the relative location of the winch apparatus and the sheave wheel disposed at the top of derrick structure 70, as well as being dependent upon the position of sheave wheel 75 mounted via frame member 76 and chains 78 and 79. Thus, prior art sheave wheel 75 as shown in FIG. 1 provided for the angular adjustment of guide arms 81 and 81' as by the frictional engagement between the guide arms 81 and 81' as at pivot point 82.

Figure 2:
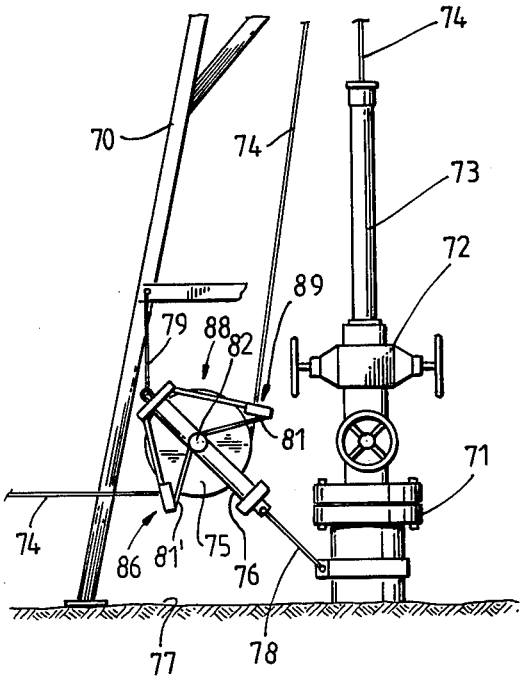
FIG. 2 is a plan view of a sheave wheel being used in well-logging operations and is equipped with the safety enhancement device of the present invention.
Figure 3:
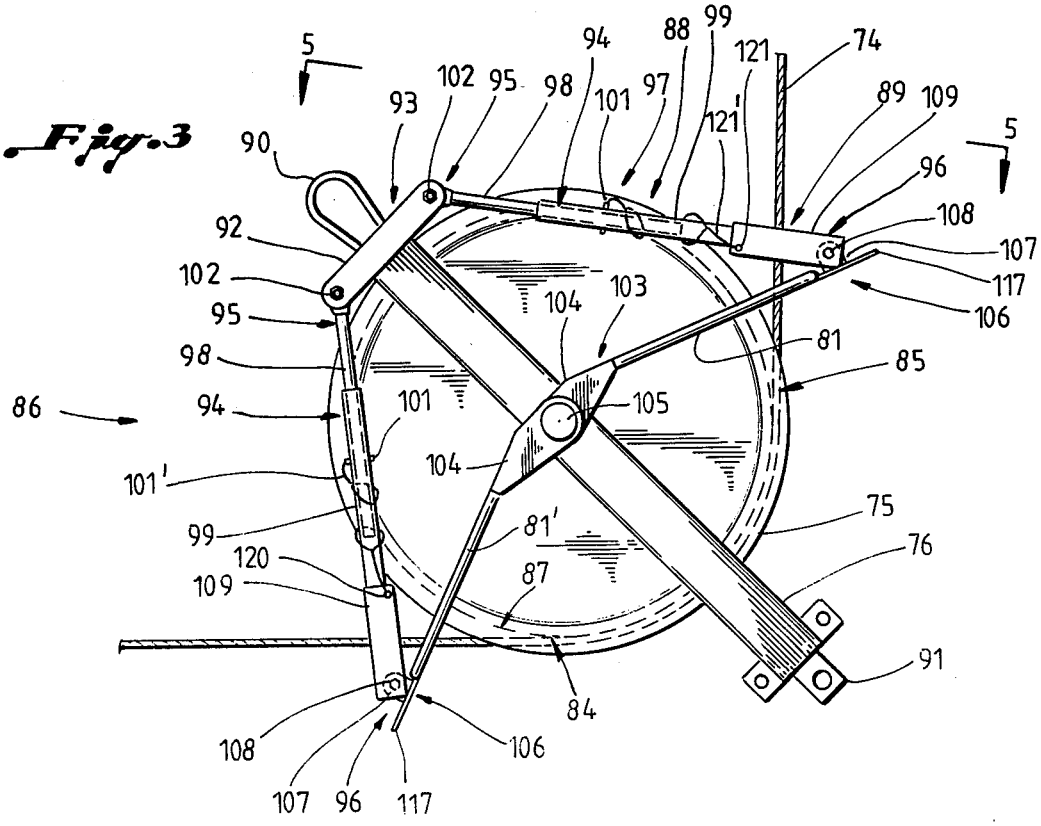
FIG. 3 is an enlarged side view of the safety enhancement device of the present invention.

With reference now to FIGS. 2 and 3, the safety enhancement device 86 of the present invention will be generally described. As in FIG. 1, sheave wheel 75 is rotatably mounted within a frame member 76 which has its ends mounted to derrick structure 70 and wellhead 71 as by chains 79 and 78. Well-logging cable 74 travels around sheave wheel 75 in the same manner as previously described with respect to FIG. 1. Guide arms 81 and 81' serve as a means for guiding and restraining the well-logging cable 74 as it travels around sheave wheel 75. The grooved surface of sheave wheel 75 is shown by phantom line 87 whereby its pinch-points 84 and 85 are shown at the points whereat well-logging cable first contacts the outer groove 87 of sheave wheel 75.

As seen generally in FIG. 2 and in greater detail in FIG. 3, the safety enhancement device 86 of the present invention is shown to generally comprise: a means for guiding and restraining the well-logging cable 74 as it travels around the sheave wheel 75, or guide arms 81 and 81', as modified in accordance with the present invention which modification will be described in greater detail in connection with FIG. 6; means for stabilizing and positioning 88 the guiding and restraining means 81 and 81' with respect to the sheave wheel 75; and means for assisting 89 in the prevention of foreign objects, such as workmen's hands, passing through the guiding and restraining means 81 and 81', whereby the foreign objects do not become disposed between the well-logging cable 74 and sheave wheel 75, such as at pinch-points 84 and 85. With reference to FIG. 3 it is seen that frame member 76 is provided with a pear-shaped link 90 adapted to have chain 79 secured thereto, and a lower chain mounting 91 adapted to have chain 78 secured thereto as shown in FIGS. 1 and 2. Frame member 76 has a frame bracket 92 secured to one end 93 of frame member 76 which frame bracket 92 may be secured to frame member 76 in any suitable fashion, such as by welding or bolting it thereto.

Figure 5:
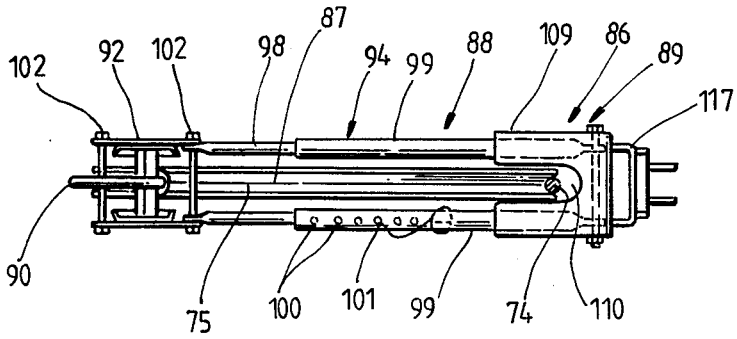
FIG. 5 is a top view along line 5—5 of FIG. 3.

Still referring to FIG. 3, it is seen that the stabilizing and positioning means 88 comprises at least one, and preferably two extendable members 94 each having a first end 95 associated with the frame member 76 and their second ends 96 associated with the guiding and restraining means 81 and 81'. Stabilizing and positioning means 88 may include a means for adjusting and locking 97 the length of at least one, and preferably both extendable members 97. Preferably, extendable members 94 are comprised of inner and outer tubular arms 98 and 99 with the inner tubular arm 98 slidingly disposed within the outer tubular arm 99. Each of the inner and outer arms 98 and 99 may be provided with a plurality of holes 100, as seen in FIGS. 5 and 6, and a pin member 101 adapted to be inserted into holes 100 when they are in a mating relationship. Pin members 101 may be secured to safety enhancement device 86 as by a cord or chain 101', whereby the possibility of pin members 101 being lost is minimized. The first ends 95 of extendable members 94 are pivotably mounted with respect to frame member 76 as by pivot pins 102 disposed within frame bracket 92. The first ends 103 of the guiding and restraining means, or guide arms 81 and 81' are pivotably mounted with respect to frame member 76 as by guide arm brackets 104 pivotably mounted to pivot pin 105. The second ends, 106 of guide arms 81 and 81' are in turn pivotably mounted to the second ends 96 of extendable members 94 as by a bracket 107 and pivot pin 108. Thus, the guiding and restraining means 81 and 81' and the stabilizing and positioning means 88 are each pivotably mounted with respect to each other and with respect to the sheave wheel frame member 76. It should of course be readily apparent to those skilled in the art that the location of bracket 92 could be reversed and disposed at the other end of frame member 76, as well as reversing the location of extendable members 94. In that situation, means for assisting 89 could be adjustably mounted upon guide arms 81 and 81'. Further, other suitable extendable members, other than inner and outer tubular arms 98 and 99, could be utilized.

Figure 6:
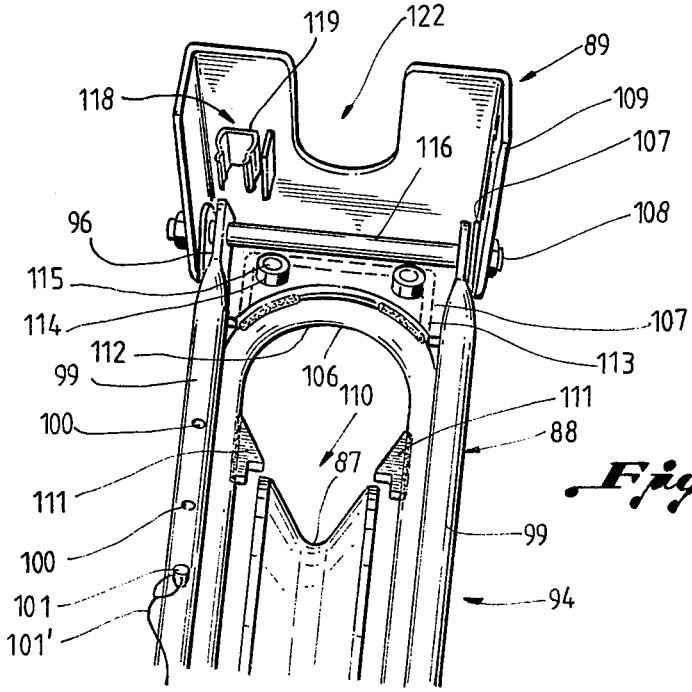
FIG. 6 is an enlarged top view of a portion of the safety enhancement device of the present invention.

Turning now to FIGS. 5 and 6, the means for assisting 89 in the prevention of foreign objects passing through the guiding and restraining means 81 and 81' will be described in greater detail. Preferably, the assisting and prevention means 89 may comprise at least one guard plate 109 adjustably mounted with respect to the guiding and restraining means 81 and the stabilizing and positioning means 88. Preferably, a guard plate 109 is provided with each stabilizing and positioning means 88, as seen in FIG. 3. With reference to FIG. 6 it is seen that guide arm 81 has an opening 110 disposed at its second end 106; opening 110 being sized to allow not only well-logging cable 74 to pass therethrough but also to allow a conventional well-logging tool connector (not shown) to also pass therethrough. Guide arm 81 may also include two angled guide surfaces 111 which, in conjunction with the inner curve surface 112 disposed at the second end 106 of guide arm 81, serve to guide and restrain the well-logging cable 74 as it travels within the grooved surface 87 around sheave wheel 75. The unmodified, prior art guide arm 81, as shown in FIG. 1, includes a guide arm eyelet 113 (shown in phantom lines) which served as a handle for grasping and moving guide arm 81 with respect to sheave wheel frame member 76.

Still with reference to FIGS. 5 and 6, it is seen that a guard plate bracket 107 is mounted, as by nuts and bolts 114 and 115, to the guiding and restraining means, or guide arm 81. Nuts and bolts 114 and 115 thus bolt guard plate bracket 107 to the guide arm eyelet 113. Guard plate 109 is then in turn pivotably mounted with respect to both the guiding and restraining means 81 and the stabilizing and positioning means 88 as by pivot pin 108 which passes through guard plate bracket 107. As seen in FIGS. 3, 5 and 6, the stabilizing and positioning means 88, or second ends 96 of extendable members 94 are likewise pivotably mounted to the second ends 106 of guide arm 81 via pivot pin 108 and guard plate bracket 107. A tubular spacer 116 may be disposed about pivot pin 108 to maintain the relationship between the ends 96 of extendable members 94 and second ends 106 of guide arms 81. As shown in FIGS. 3 and 5, guard plate bracket 107 may be provided with an integral handle 117 the use of which will be hereinafter described. Further, as shown in FIG. 6, guard plate 109 may be provided with a means for releasably securing 118 the guard plate 109 to the stabilizing and positioning means 88, or extendable members 94. Preferably, the releasable securing means comprises a clip member 119 affixed in a suitable fashion to the underside of guard plate 109, such as by welding. As guard plate 109 is pivoted about pivot pin 108, clip member 119 will engage outer tubular arm 99 of extendable member 94 to thus releasably secure guard plate 109 thereto. Additionally, as seen in FIG. 3, each guard plate 109 may also be provided with an opening 120 through which a pin member 121 (with attached cord or chain 121') may be inserted, which pin member 121 would engage the underside of outer tubular arm 99 to thus further releasably secure guard plate 109.

In FIG. 6, guard plate 109 is shown disposed in its open position whereby the well-logging cable 74 and well-logging tool connector (not shown) may be passed through the opening 110 in guide arm 81 when a rigging operation is conducted prior to the commencement of well-logging operations. In FIGS. 3 and 5, guard plate 109 is shown disposed in its closed position, releasably secured to the stabilizing and positioning means 88 as by clip member 119 and pin member 121. Thus, as seen in FIG. 5 the opening 110 of guide arm 81 is partially blocked by guard plate 109. Guard plate 109 has an opening 122 which is sized to allow the well-logging cable 74 to pass therethrough, and is further sized to assist in preventing foreign objects, such as a workman's hands, from passing through opening 122. Were a workman to negligently grasp the moving well-logging cable 74, guard plate 109 would serve to assist in preventing his hand from being pulled into pinch-point 85, since opening 122 is sized small enough to assist in preventing his hand from passing beyond guard plate 109.

Figure 4:
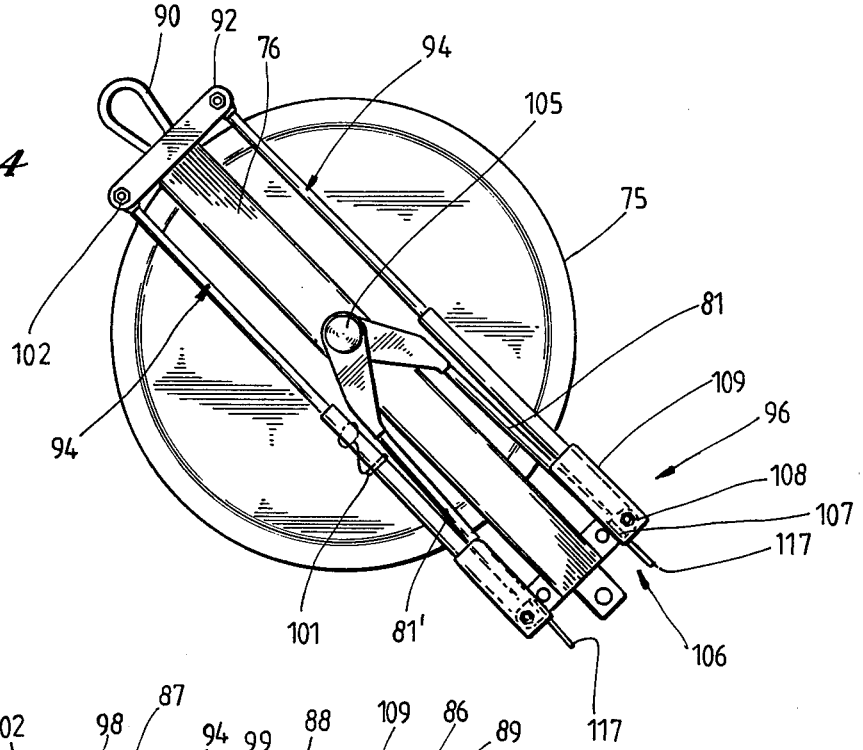
FIG. 4 is a side view illustrating the safety enhancement device of the present invention in a collapsed position whereby the sheave wheel may be moved to another location.

With reference to FIGS. 3 and 4, the operation of the safety enhancement device 86 of the present invention will be described. In FIG. 4, the safety enhancement device 86 of the present invention is shown in its first collapsed position which readily allows the transportation of sheave wheel 75 and the sheave wheel frame member 76. As shown in FIG. 4, extendable members 94 of the stabilizing and positioning means 88 have been pivoted downwardly with respect to the frame bracket 92 and pivot pins 102. Because of the pivotal connection between the second ends 96 of extendable members 94 and the second ends 106 of guide arms 81 and 81′ via guard plate brackets 107 and pivot pins 108, guide arms 81 are likewise downwardly pivoted about pivot point 105. By inserting pin member 101 through the mating holes 100 in extendable members 94, extendable members 94 and guide arms 81 and 81′ are locked into the position shown in FIG. 4. All that is necessary to move sheave wheel 75 is to grasp mounting member 91 or pear-shaped link 90 to rotate extendable members 94 and guide arms 81 until they are disposed in a spaced relationship from the ground, and the sheave wheel 75 is merely rolled to wherever it is desired to be moved.

Upon assembling sheave wheel 75 and frame member 76 to derrick 70, pin members 101 are removed and extendable arms 94 and guide arms 81 and 81′ are extended and pivoted outwardly to their positions shown in FIG. 3 by pulling outwardly on handles 117. Pin members 120 are removed and guard plates 109 are opened to the position shown in FIG. 6. After the well-logging tool connector and well-logging cable 74 have been passed through openings 110 in guide arms 81 and 81′, guard plates 109 are pivoted downwardly into their closed position shown in FIG. 3. Pin members 121 are inserted into openings 120, and clip members 119 are engaged with extendable arms 94 to releasably secure guard plates 109 in their operating position adjacent pinch-points 84 and 85.

It is to be understood that the invention is not limited to the exact details of construction, operation, exact materials or embodiment shown and described, as obvious modifications and equivalents will be apparent to one skilled in the art; for example, the guard plates could be releaseably secured and biased toward their operating position as by a spring-loaded mounting. Further, the guard plate could be supported by one or more support members which dispose the guard plate in a position adjacent to the pinch-point of the sheave wheel, but which support members do not guide or restrain the well-logging cable. Accordingly, the invention is therefore to be limited only by the scope of the appended claims.

I claim:

1. A safety enhancement device for a well-logging cable sheave wheel rotatably mounted in a frame member, the sheave wheel having a pinch-point located where the well-logging cable first contacts the sheave wheel, comprising:

means for guiding and restraining the well-logging cable as it travels around the sheave wheel;

means for stabilizing and positioning the guiding and restraining means with respect to the sheave wheel; and means for assisting in the prevention of foreign objects passing into the pinch point, whereby the foreign objects do not become disposed between the well logging cable and the sheave wheel; and said stabilizing and positioning means comprises at least one extendable member having a first end associated with the frame member and a second end associated with the guiding and restraining means, said at least one extendable member comprises an inner and an outer tubular arm with the inner tubular arm slidingly disposed within the outer tubular arm; and means for adjusting and locking the length of said at least one extendable member comprising a plurality of mating holes in said arms and a pin member adapted to be inserted in the mating holes.

2. A safety enhancement device for a well logging cable sheave wheel rotatably mounted in a frame member, the sheave wheel having a pinch point located where the well logging cable first contacts the sheave wheel, comprising;

means for guiding and restraining the well logging cable as it travels around the sheave wheel;

means for stabilizing and positioning the guiding and restraining means with respect to the sheave wheel;

means for assisting in the prevention of foreign objects passing into the pinch point, whereby the foreign objects do not become disposed between the well logging cable and the sheave wheel; and means for pivotally mounting the guiding and restraining means and the stabilizing and positioning means with respect to each other and with respect to the sheave wheel frame member; wherein said assisting in prevention means comprises at least one guard plate adjustably mounted with respect to the guiding and restraining means and the stabilizing and positioning means;

said stabilizing and positioning means includes at least two extendable arms having their first ends pivotally mounted to an end of the sheave wheel frame member;

said guiding and restraining means includes at least two guide arms having their first ends pivotably mounted to the sheave wheel frame member and their second ends pivotably mounted to the second ends of the extendable arms; and said guard plate is pivotably mounted with respect to the second ends of the guide arms and extendable arms.

3. A safety enhancement device for a well logging cable sheave wheel rotatably mounted in a frame member, the sheave wheel having a pinch point located where the well logging cable first contacts the sheave wheel, comprising;

means for assisting in the prevention of foreign objects passing into the pinch point, whereby the foreign objects do not become disposed between the well logging cable and the sheave wheel;

first means for supporting the means for assisting in a position adjacent the pinch point;

said assisting in prevention means comprises at least one guard plate adjustable mounted with respect to the first support means; and wherein the first support means includes at least one extendable member comprising an inner and an outer tubular arm with the inner tubular arm slidingly disposed within the outer tubular arm, and adjusting and locking means comprising a plurality of mating holes in said arms and a pin member adapted to be inserted in the mating holes.

4. A safety enhancement device for a well logging cable sheave wheel rotatably mounted in a frame member, the sheave wheel having a pinch point located where the well logging cable first contacts the sheave wheel, comprising;

means for assisting the prevention of foreign objects passing into the pinch point, whereby the foreign objects do not become disposed between the well logging cable and the sheave wheel; and first means for supporting the means for assisting in a position adjacent the pinch point; wherein said first support means comprising at least one extendable member having a first end associated with the frame member and a second end associated with a second support means;

said first support means and said second support means being each pivotably mounted with respect to each other and with respect to the sheave wheel frame member;

said assisting in prevention means comprises at least one guard plate adjustably mounted with respect to the first and second support means;

said first support means includes at least two extendable arms having their first ends pivotably mounted to an end of the sheave wheel frame member; said second support means includes at least two support arms having their first ends pivotably mounted to the sheave wheel frame member, and their second ends pivotably mounted to the second ends of the extendable arms; and said guard plate is pivotably mounted with respect to the second ends of said support arms and extendable arms.

* * * * *